United States Patent [19]

Deruns

[11] 4,205,519

[45] Jun. 3, 1980

[54] ELECTRONIC TIME-PIECE WITH ACOUSTIC SIGNAL, FOR SIGNALLING A PARTICULAR WORKING MODE

[75] Inventor: Nicole Deruns, La Chaux-de-Fonds, Switzerland

[73] Assignee: Ebauches Electroniques SA, Marin, Switzerland

[21] Appl. No.: 955,146

[22] Filed: Oct. 27, 1978

[30] Foreign Application Priority Data

Dec. 21, 1977 [CH] Switzerland ..... 15776/77

[51] Int. Cl.[2] ..... G04C 21/00; G04B 27/00

[52] U.S. Cl. ..... 368/73; 368/245; 368/185

[58] Field of Search ..... 58/4 A, 23 R, 23 A, 58/38 R, 38 A, 39, 39.5, 50 R, 57, 58, 57.5, 152 B, 21.12, 85.5

[56] References Cited

U.S. PATENT DOCUMENTS 3,210,924 10/1965 Dodd ..... 58/38

3,728,855 4/1973 Preiser ..... 58/38 R

*Primary Examiner*—Edith S. Jackmon

*Attorney, Agent, or Firm*—Wender, Murase & White

[57] ABSTRACT

Electronic timepiece delivering an acoustic signal to signalize to the user a particular state of working mode. The invention applies more particularly to timepieces with a digital display for indicating the time and the date, the same display being used to indicate the time of alarm. In such a timpiece, it is necessary to be able to make corrections of the time and the date in the watch correcting mode as well as corrections of the time of alarm in the alarm correcting mode. It is this alarm correcting mode which, in the described example, is signalized by an acoustical signal.

The timepiece includes an oscillator, a frequency divider, at least one display unit, an alarm device, a memory and a comparator for the time of alarm, a control logic circuit and a first and a second control means. It includes further an electronic circuit controlled by the control logic circuit delivering a periodic signal of predetermined duration whiich is generated from signals delivered by the frequency divider to activate the electroacoustic transducer of the alarm device when the timepiece has been set in a determined working mode by an action on the control means which are connected to the control logic circuit.

7 Claims, 7 Drawing Figures

ELECTRONIC TIME-PIECE WITH ACOUSTIC SIGNAL, FOR SIGNALLING A PARTICULAR WORKING MODE

BACKGROUND OF THE INVENTION

The present invention concerns an electronic timepiece capable of delivering an acoustic signal to signalize that the timepiece is in a well determined state of working mode. The invention applies more particularly to timepieces with a digital display for indicating the time and the date, the same digital display being used to indicate the time of alarm. Moreover, the timepiece comprises also an analog display of the time which is independent of the digital display and of the time of alarm. In such a timepiece, it is necessary to be able to make a correction of the time or of the date in the watch correcting mode as well as a correction of the time of alarm in the alarm correcting mode. In order to avoid any confusion for the user of the timepiece, it is necessary that he could easily distinguish in which correcting mode his timepiece is set. Therefore, an indication must be given to the user to allow him to know if the timpiece is set in the watch correcting mode or in the alarm correcting mode.

Generally speaking, the distinction between the different modes is done by a visual indication on the display unit. However, it could happen, as in the timepiece of the example which will be discussed further on, that such an indication is not always possible, e.g. because all elements of the display are already used for the display of other indications. It is then necessary to find an other solution which does not utilize the display unit.

SUMMARY OF THE INVENTION

The solution praised by the present invention utilize the electroacoustic transducer of the alarm device to deliver, when the timepiece is in the alarm correcting mode, an acoustical signal which is periodic, has a predetermined duration and is different of the alarm signal. To this end, the timepiece according to the present invention comprises an oscillator, a frequency divider, at least one display unit, an alarm device, a memory and a comparator for the time of alarm, a control logic circuit and a first and a second control means. It also comprises an electronic circuit controlled by the control logic delivering the periodic signal of predetermined duration which is generated from signals delivered by the frequency divider to activate the electroacoustic transducer of the alarm device when the timepiece is in a determined working mode.

The present invention will be described by way of example, with reference to the accompanying drawings.

DESCRIPTION OF THE PREFERRED EMBODIMENT

Figure 1:
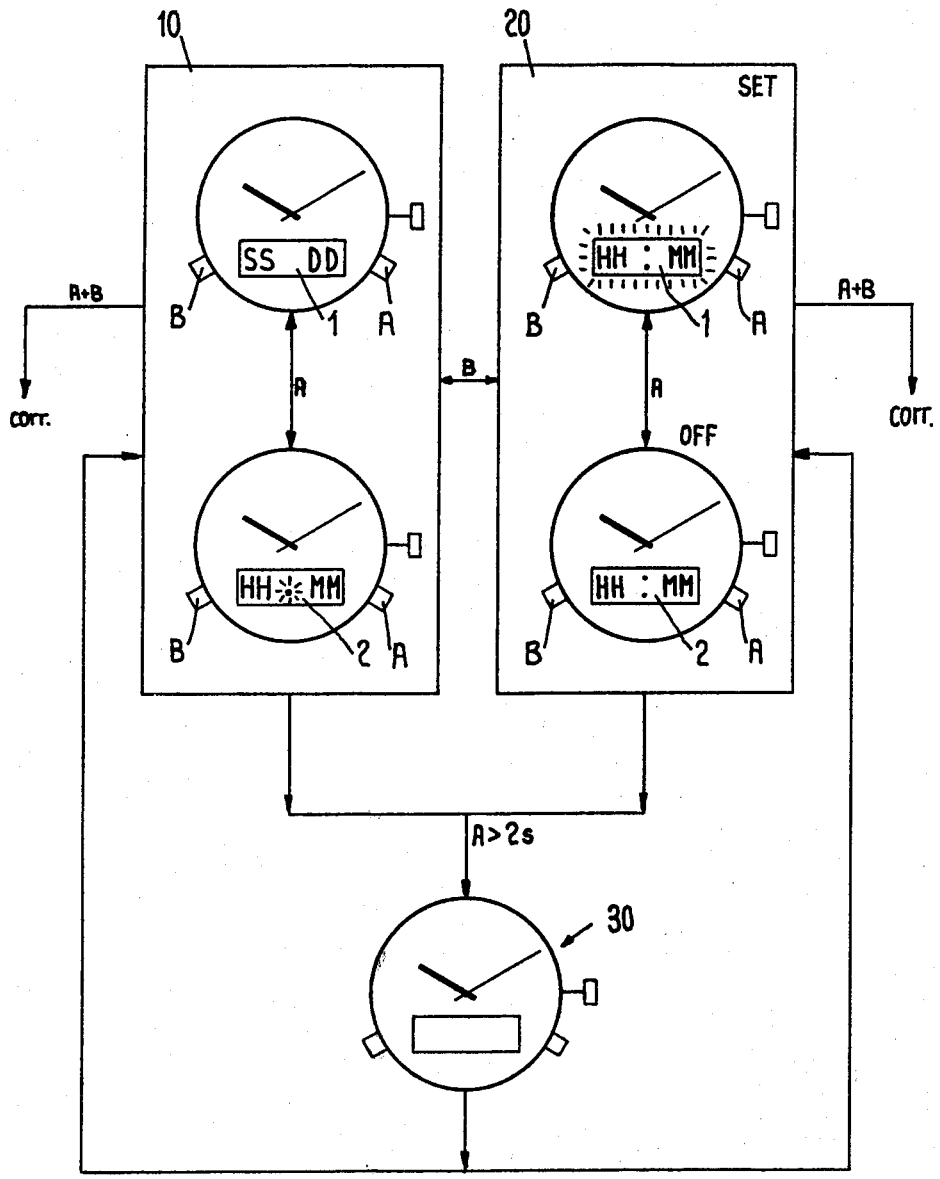
FIG. 1 is a schematic drawing showing the manipulations to be executed to pass from the watch mode to the alarm mode.

FIG. 1 shows that, in the timepiece described as an example, one passes from the watch mode to the alarm mode and from the alarm mode to the watch mode by actuating the control means B, e.g. a push-button, as symbolically indicated by the arrow B placed between the two rectangles "watch mode" 10 and "alarm mode" 20. In each of these modes, two permanent displays 1 and 2 are provided and one passes from the display 1 to the display 2 and back to the display 1 by actuating the control means A, e.g. a push-button. FIG. 1 shows also that it is possible, from each of the two indicated modes to switch on the alarm by pushing the push-button A for more than two seconds. By such an action, it is possible to demonstrate how the alarm signal sounds, without any need to previously set the timepiece in the alarm time. When the push-button A is released, the timepiece comes automatically back again in its starting position: either the watch mode 10 or the alarm mode 20. In the watch mode, two permanent displays may be selected by the push-button A: a display of the hours (HH)—minutes (MM) with blinking at a rate of one hertz of the point disposed between HH and MM and a display of the seconds (SS)—Date (DD). In the same way, in the alarm mode, two permanent displays are also possible, which can be selected by the pushbutton A: the so called "off" display of the hour (HH) and the minute (MM) of alarm, such as HH:MM, in which all the elements are permanently and continuously displayed, with the meaning that the alarm will not sound when the timepiece shall reach the alarm time, and a so called "set" display of the alarm time, such as HH:MM in which all the displayed elements are blinking at a rate of one hertz to indicate that the alarm shall sound when the alarm time shall be reach. FIG. 1 shows also that in each of the two possible working modes, the simultaneously actuating of the push-buttons A and B set the timepiece in the correcting mode, Corr.

Figure 2:
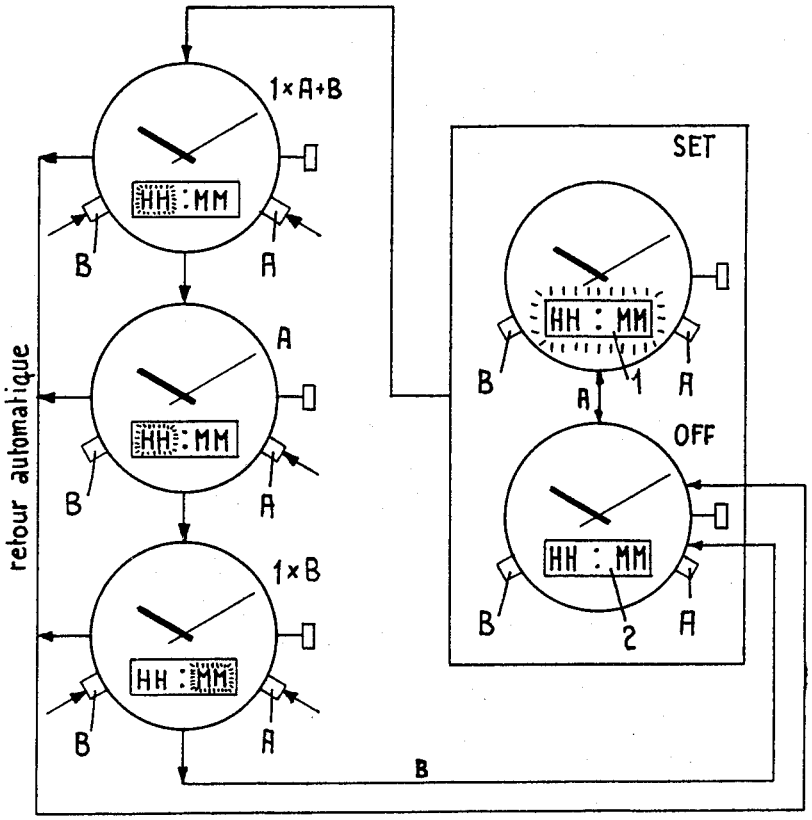
FIG. 2 is a schematic drawing showing the manipulations to be executed for the corrections in the alarm correcting mode.

The manipulations for the corrections which may be executed in the alarm correcting mode are indicated in FIG. 2. It is this alarm correcting mode which is indicated to the user of the timepiece by an acoustical signal, in the preferred embodiment of the present invention. FIG. 2 shows that the selection of the hours is done by pushing both of the push-buttons A and B. The correction of the hours is then executed by an action on A. Another action on B will select the minutes which are easily corrected by a further action on A. After the corrections have been executed, an action on the push-button B sets the timepiece back in the "off" display state. If this last action on B is omitted, the timepiece switches automatically back to the "off" display state after a time of ten or twenty seconds has elapsed, whatever the state of the correcting cycle may be.

Let us suppose now that the timepiece is in the alarm mode and that it is wished to execute a correction of the time of alarm. As indicated in FIG. 1, it is then necessary first to select the alarm correcting mode by acting simultaneously on the push-buttons A and B. However, it is practically impossible to realize a true simultaneity of the actuation of the push-buttons A and B. Therefore, if one presses for example B before A, it could happen that the timepiece passes from the alarm mode to the watch mode and finally to the watch correcting mode instead of passing to the alarm correcting mode. Moreover, in the watch mode, it is also necessary to simultaneously actuate the push-buttons A and B to pass to the watch correcting mode. If, during this manipulation, B is pressed before A, it could happen that the timepiece passes from the watch mode to the alarm mode and finally to the alarm correcting mode instead of passing to the watch correcting mode. The preceding shows that it is necessary to provide a security to avoid a wrong selection of the correcting mode. Such a security, which will be described further on, comes in addition to the one which is provided by the acoustical signal to signalize to the user of the timepiece that the latter is in the alarm correcting mode.

Figure 3:
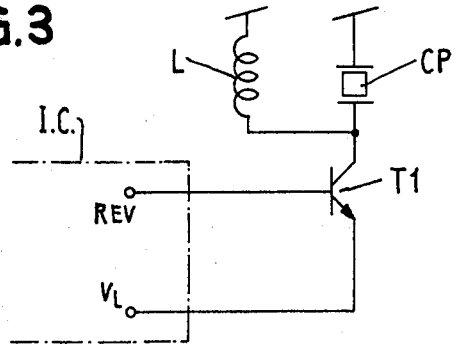
FIG. 3 is a diagram of the circuit which controls the electroacoustic transducer, external to the integrated circuit of the timepiece.

FIG. 3 shows the diagram of the circuit which controls the electro-acoustic transducer. The circuit is not contained in the integrated circuit of the timepiece. The electro-acoustic transducer if for example a piezoelectric ceramic CP which is adhered to a membrane and electrically connected in parallel with an excitation coil L placed in the collector circuit of a control transistor T1. The latter is controlled by alarm signals delivered to its base electrode by the terminal REV of the integrated circuit IC. The emitter of the transistor T1 is connected in the integrated circuit IC to the appropriate pole of the supply source.

Figure 4:
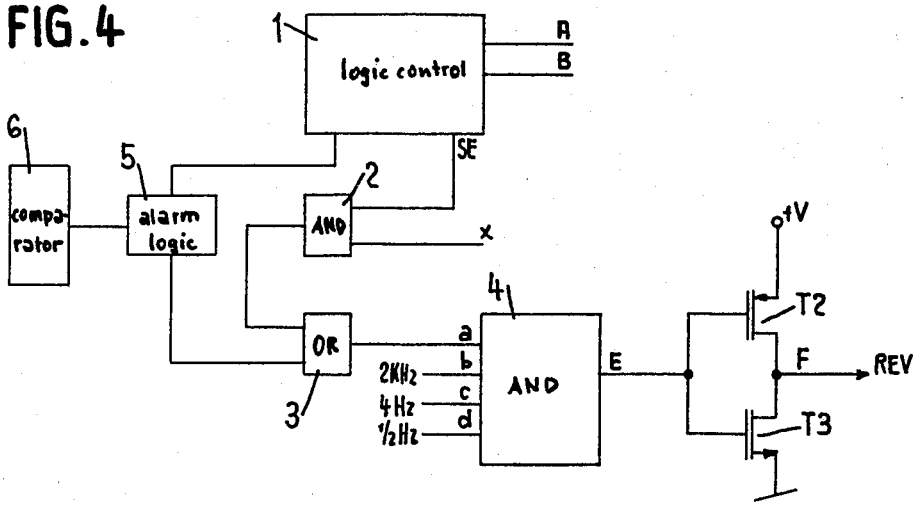
FIG. 4 is a block-diagram of a control circuit for an acoustical signal according to the invention.
Figure 5:
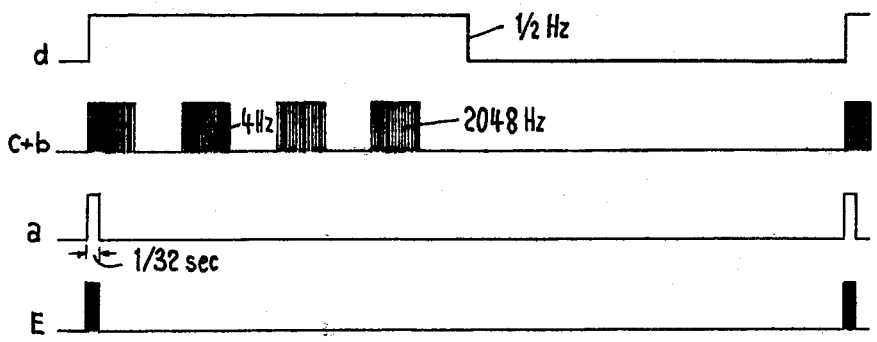
FIG. 5 is a timing diagram of the signals of the circuit of FIG. 4 and FIGS. *6a* and *6b* are timing diagrams illustrating the working of an additional security of the circuit according to the invention.
Figure 6A:
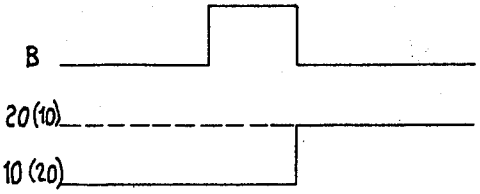
Figure 6B:
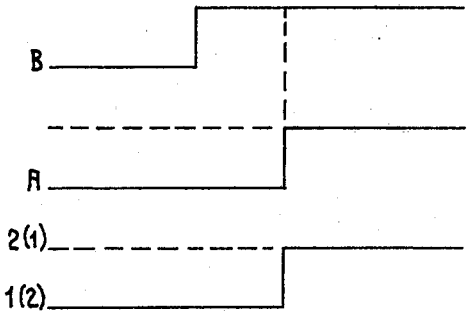

FIG. 4 shows the block-diagram of the circuit delivering an acoustical signal in the alarm correcting mode. It has already been said that, in the alarm mode, it is necessary to press simultaneously the push-buttons A and B to pass to the alarm correcting mode. In that case, the control logic circuit delivers a logic state 1 at its output SE. This logic state 1 opens then the AND gate 2. The latter receives every two seconds, for example, on its second input x a signal of a much shorter duration e.g. of 1/32 sec. The output of gate 2 is connected to a first input of an OR gate 3 whose output is connected to the input a of an AND gate 4. The second input of the gate 3 is connected to the output of the alarm logic circuit 5 which is in the logic state 0 when the timepiece is in the alarm correcting mode. The other inputs b, c and d of the gate 4 receive signals having a repetition frequency of 2 kHz, 4 Hz and 0.5 Hz respectively which are delivered by a frequency divider not shown. Gate 2 being open and the output of the alarm logic circuit 5 being in the logic state 0, the signal at the input a of the gate 4 is the same than that at the input x of the gate 2. The output E of the gate 4 is connected to the common point of the gates of an inverter comprised of the complementary MOS transistors T2 and T3. The output F of the inverter is connected to the terminal REV of the diagram of FIG. 3. FIG. 5 shows the input and output signals of the gate 4. One can see that the combination of the different input signals produces at the output E a pulse having a repetition frequency of 2048 Hz, a duration of 1/32 sec. and which is produced every two seconds. The pulse is the control signal for the transistor T1 of FIG. 3. Therefore, in the case where the timepiece is in the alarm correcting mode, an acoustical signal of a frequency of 2048 Hz is given every two seconds during 1/32 sec. It is to be seen that such a signal with a short duration and a low pulse repetition frequency of 0.5 Hz consumes very little energy and does not appreciably contributes to the shortening of the lifetime of the batteries feeding the timepiece.

Let us examine now the additional security which has been mentioned above. The control logic circuit 1 of FIG. 4 is conceived in such a way that it responds on the trailing or negative edge only of the pulse delivered by the actuation of the push-button B, as illustrated in FIG. *6a*. This permits to avoid to pass from the alarm mode to the watch mode or from the watch mode to the alarm mode when it is desired to pass from the watch mode or the alarm mode to the corresponding correcting mode. Moreover, as indicated in FIG. *6b*, the security allows, in the case of a so called "simultaneous" action on the push-buttons A and B, to pass to the correcting mode event if the push-button B is actuated before the push-button A. The circuit 1 is conceived so that the logic state at its output SE is the conjunction of the logic states at its inputs A and B.

The circuit according to the present invention, which is described as an example in FIG. 4, delivers at relatively long time intervals (two seconds) an acoustical signal which is easily recognized, has a short duration (1/32 sec.), signalizing to the user of the timepiece that the latter is in the alarm correcting mode. If this acoustical signal is not emitted although a manipulation has been made to pass in the correcting mode, this means that the timepiece is in the watch correcting mode.

In the above-mentioned example, the acoustical signal is delivered when the timepiece is in the alarm correcting mode. It would however also be possible in principle to deliver such an acoustical signal to indicate to the user of the timepiece that the latter is in any other possible state of working mode, e.g. in the watch correcting mode.

The diagram of FIG. 4 includes an alarm logic circuit 5 and a digital comparator 6. When the digital time of the timepiece coincides with the alarm time, and when the alarm is switched on (alarm "set" mode), these circuits deliver through gate 3 an alarm logic state 1 at the input a of the gate 4. In that case, the alarm is working and, if the timepiece includes a stepping motor, it may happen that the alarm pulses and those delivered to the stepping motor to drive it, appear simultaneously. This leads to a relatively high current consumption which is undesirable and the magnetic field produced by the alarm excitation coil L of FIG. 3 may disturb the correct working of the stepping motor. To avoid such drawbacks it is possible to shift in time the alarm pulses with regard to the pulses which drive the stepping motor, so that they never coincide. The pulse shifting of such pulses forms the object of the U.S. Patent Application, Ser. No. 955,199, filed on Oct. 27, 1978, from the same assignee as the one of the present application. If such a pulse shifting is applied to the circuit of the present invention, it is obvious that the phase of the signal at the input x must be adapted to the one of the shifted pulses.

We claim:

1. An electronic timepiece capable of delivering an acoustic signal to indicate a particular state of working mode of the timepiece, comprising:

an oscillator for producing reference pulses of a high frequency;

frequency divider means connected to said oscillator for producing low frequency control signals and signals at audio frequencies in response to said reference pulses;

display means connected to said frequency divider means for indicating a time and a time of alarm in response to said low frequency control signals;

a logic control circuit having first and second actuating means for controlling various working modes of the timepiece;

memory and comparator means connected to said logic control circuit for producing an alarm signal when said time and said time of alarm coincide;

an electronic circuit connected to said logic control circuit, said memory and comparator means, and said frequency divider means for receiving said signals at audio frequencies, said electronic circuit further delivering a first periodic audible signal in response to said alarm signal and a second periodic audible signal of predetermined duration when the timepiece is in a determined state of working mode, said second periodic audible signal being different from said first periodic audible signal.

2. A timepiece according to claim 1, wherein said electronic circuit comprises an alarm device including an electroacoustic transducer capable of producing said first and second periodic audible signals.

3. A timepiece according to claim 2, wherein said electronic circuit comprises first and second AND gates, and OR gate and an inverter, said first AND gate having a first input connected to said logic control circuit and a second input connected to said frequency divider means for receiving one of said signals at audio frequencies, said OR gate having a first input connected to the output of said first AND gate and a second input connected to said memory and comparator means for receiving said alarm signal, and said second AND gate having a first input connected to the output of said OR gate and further having a set of inputs connected to said frequency divider means for receiving said signals at audio frequencies, and said inverter having an input connected to the output of said second AND gate and an output connected to said alarm device for delivering to said electroacoustic transducer a periodic signal.

4. A timepiece according to claim 1, wherein said control logic circuit receives input signals from said first and second actuating means, said input signal of said second actuating means having a trailing edge, said control logic circuit responding only on said trailing edge and delivering to said electronic circuit a signal having a logic state which is the conjunction of said input signals.

5. A timepiece according to claim 1, wherein said display means comprises a digital display unit and an analog display unit, and said determined state of working mode is a correcting mode of the timepiece.

6. A timepiece according to claim 5, wherein said digital display unit is used to alternatively indicate a watch mode and an alarm mode.

7. A timepiece according to claim 2, further comprising a battery, wherein said periodic audible signals produced by said electroacoustic transducer have a period greater than one half second, a pulse duration smaller than said period and an acoustical intensity which is determined in such a manner as not to incommode the user of the timepiece or to appreciably reduce the lifetime of said battery.

* * * * *